US008978826B2

(12) United States Patent
Kim et al.

(10) Patent No.: US 8,978,826 B2
(45) Date of Patent: Mar. 17, 2015

(54) COMPRESSOR

(75) Inventors: Jinkook Kim, Seoul (KR); Kyeongho Kim, Seoul (KR); Woong Cho, Seoul (KR); Kyoungjun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 408 days.

(21) Appl. No.: 13/500,001

(22) PCT Filed: Nov. 15, 2010

(86) PCT No.: PCT/KR2010/008056

§ 371 (c)(1),
(2), (4) Date: Apr. 3, 2012

(87) PCT Pub. No.: WO2011/062402

PCT Pub. Date: May 26, 2011

(65) Prior Publication Data

US 2012/0201699 A1 Aug. 9, 2012

(30) Foreign Application Priority Data

Nov. 18, 2009 (KR) ..... 10-2009-0111599

(51) Int. Cl.
*F01M 1/00* (2006.01)
*F04B 39/02* (2006.01)

(52) U.S. Cl.
CPC ..... *F04B 39/0238* (2013.01)
USPC ..... 184/6.16; 417/372

(58) Field of Classification Search
CPC ..... F04B 39/0238
USPC ..... 184/6.16; 417/372
See application file for complete search history.

(56) References Cited

U.S. PATENT DOCUMENTS

| | | | | |
|---|---|---|---|---|
| 5,304,045 | A * | 4/1994 | Hoshino et al. | 417/372 |
| 5,803,718 | A * | 9/1998 | Woo | 417/372 |
| 7,100,743 | B2 * | 9/2006 | Park et al. | 184/6.16 |
| 2002/0050424 | A1 * | 5/2002 | Iversen et al. | 184/6.16 |
| 2002/0050425 | A1 * | 5/2002 | Iversen et al. | 184/6.16 |
| 2003/0010573 | A1 * | 1/2003 | Kueon | 184/6.16 |
| 2009/0101442 | A1 * | 4/2009 | Katayama et al. | 184/6.16 |

FOREIGN PATENT DOCUMENTS

| | | |
|---|---|---|
| CN | 1513087 | 7/2004 |
| CN | 1621685 | 6/2005 |

(Continued)

OTHER PUBLICATIONS

International Search Report and Written Opinion dated Aug. 25, 2011 issued in Application No. PCT/KR2010/008056.

(Continued)

*Primary Examiner* — William E Dondero
*Assistant Examiner* — Robert T Reese
(74) *Attorney, Agent, or Firm* — Ked & Associates, LLP

(57) ABSTRACT

Disclosed is a compressor capable of having an enhanced performance by sufficiently supplying oil to components where sliding occurs not only in a high speed driving mode but also in a low speed driving mode. The compressor may increase an oil supply amount in a low speed driving mode, but may restrict an oil supply amount when a rotation speed of a driving motor reaches a predetermined speed in a constant or high speed driving mode, by setting the number of turns of an external groove to be approximately 1.75, and by forming an oil feeder in a conical shape.

15 Claims, 6 Drawing Sheets

(56) References Cited

FOREIGN PATENT DOCUMENTS

| | | | |
|---|---|---|---|
| KR | 10-0296580 | B1 | 5/2002 |
| KR | 10-2003-0010963 | A | 2/2003 |
| KR | 10-0745711 | B2 | 8/2007 |
| KR | 10-0771594 | B1 | 10/2007 |

OTHER PUBLICATIONS

Chinese Office Action dated Jan. 6, 2014.

* cited by examiner

COMPRESSOR

TECHNICAL FIELD

The present invention relates to a compressor, and more particularly, to a compressor capable of sufficiently supplying oil to components where sliding occurs not only in a high speed driving mode but also in a low speed driving mode

BACKGROUND ART

Generally, a compressor is an apparatus for compressing fluid by converting mechanical energy into kinetic energy. This compressor may be largely categorized into a hermetic compressor and a semi-hermetic compressor. In the hermetic compressor, a driving motor and a compression unit for compressing fluid by being operated by the driving motor are installed at one hermetic container. On the other hand, in the semi-hermetic compressor, the driving motor and the compression unit are installed at different hermetic containers.

The compressor may be also categorized according to a compression mechanism to compress fluid. For instance, the compressor may be categorized into a rotary compressor, a reciprocating compressor, a scroll compressor, etc. according to a compression mechanism. The reciprocating compressor serves to compress a refrigerant under configurations that a crank shaft is coupled to a rotor of a driving motor, a connecting rod is coupled to the crank shaft, and a piston coupled to the connecting rod performs a linear reciprocation in a cylinder.

FIG. 1 is a sectional view showing an example of a reciprocating compressor.

As shown, the reciprocating compressor comprises a casing 1 having oil contained at a bottom thereof, a driving motor 10 installed in the casing 1, a supporting unit 20 for elastically supporting the driving motor 10, and a compression unit 30 disposed above the driving motor 10.

The compression unit 30 includes a frame 31 elastically supported by the supporting unit 20, a cylinder block 32 integrally provided at the frame 31, a crank shaft 33 penetratingly-inserted into the frame 31 and forcibly-inserted into a rotor 12 of the driving motor 10, a piston 34 inserted into the cylinder block 32, a connecting rod 35 for converting a rotary motion of the crank shaft 33 into a linear reciprocation by connecting a cam portion of the crank shaft 33 to the piston 34, a valve assembly 36 coupled to the cylinder block 32, a discharge muffler 37 coupled to the cylinder block 32 so as to encompass the valve assembly 36, and a suction muffler 38 installed at the valve assembly 36 so as to be connected to the valve assembly 36.

Unexplained reference numeral 11 denotes a stator, F denotes an oil hole, and an SP denotes a suction pipe.

The operation of the reciprocating compressor will be explained as follows.

Once the driving motor 10 is operated, a rotation force of the driving motor 10 is transmitted to the crank shaft 33 to rotate the crank shaft 33. Then, a rotation force of the crank shaft 33 is transmitted to the piston 34 via the cam portion and the connecting rod 35. As a result, the piston 34 performs a linear reciprocation at an inner space of the cylinder block 32. Here, the valve assembly 36 is together operated to suck gas to the inner space of the cylinder block 32 through the suction muffler 38. The sucked gas is compressed, and then is discharged to outside of the casing 10 through the discharge muffler 37.

The oil contained at the bottom surface of the casing 1 is sucked through the oil hole (F) formed in the crank shaft 33 by rotation of the crank shaft 33. Then, the oil is supplied to components where sliding occurs to perform a lubrication operation, and then remains at the bottom surface of the casing 1.

The compressor constitutes a part of a refrigerating cycle apparatus which generates cool air by using a phase change of a refrigerant, and the refrigerating cycle apparatus is installed at a refrigerator or an air conditioner, etc. The refrigerator or the air conditioner has a different driving state according to a load. More concretely, when a large load is applied to the refrigerator or the air conditioner, the compressor has a large gas compression capacity. On the other hand, when a small load is applied to the refrigerator or the air conditioner, the compressor has a small gas compression capacity. When the compressor has a large gas compression capacity, the driving motor 10 of the compressor is operated in a high speed driving mode to increase a gas compression capacity. On the other hand, when the compressor has a small gas compression capacity, the driving motor 10 of the compressor is operated in a low speed driving mode to decrease a gas compression capacity. If the driving motor 10 rotates in a low speed (less than 45 Hz) due to a small gas compression capacity, the amount of oil pumped up through the oil hole (F) of the crank shaft 33 is reduced by a rotation speed of the crank shaft 33. This may cause oil to be supplied to components where sliding occurs with an insufficient amount. As a result, the components where sliding occurs are abraded, and thus are not smoothly operated. This may increase a frictional loss to lower the efficiency and to shorten a lifespan. To prevent this, an oil supply amount in a low speed driving mode may be increased through a structural change of the crank shaft.

DISCLOSURE OF INVENTION

Technical Problem

However, when the oil supply amount in a low speed driving mode is increased through a structural change of the crank shaft, an oil supply amount is drastically increased in a high speed driving mode. This may increase an input of the compressor, and increase a surface temperature, and increase a suction amount and a discharge amount. More concretely, when the compressor is in a low speed driving mode as shown in FIG. 2, an oil supply amount is low enough to be 60% or less than a proper oil supply amount. On the other hand, when the compressor is in a high speed driving mode, an oil supply amount is high enough to be 140% or more than a proper oil supply amount.

Therefore, it is an object of the present invention to provide a compressor capable of sufficiently supplying oil to components where sliding occurs not only in a high speed driving mode but also in a low speed driving mode, by increasing an oil supply amount in a low speed driving mode, and by restricting an oil supply amount in a constant or high speed driving mode by making the oil supply amount to be in a saturated state when the compressor has reached a predetermined speed.

Solution to Problem

To achieve these and other advantages and in accordance with the purpose of the present invention, as embodied and broadly described herein, there is provided a compressor, comprising: a casing having oil contained at an inner space thereof; a driving motor installed at the inner space of the casing, and configured to generate a rotation force; a compression unit installed at the inner space of the casing, and configured to compress a refrigerant by receiving a rotation force of the driving motor; and an oil supply unit configured to pump up the oil of the casing to the compression unit by using a centrifugal force generated by the rotation force of the driving motor, wherein in an assumption that a ratio between an oil supply amount and a rotation speed of the driving motor is a gradient, a gradient when the rotation speed of the driving motor is less than a predetermined speed is referred to as a 'first gradient', a gradient when the rotation speed of the driving motor is more than a predetermined speed is referred to as a 'second gradient' and the second gradient is smaller than the first gradient.

According to another aspect of the present invention, there is provided a compressor, comprising: a casing having oil contained at an inner space thereof; a driving motor installed at the inner space of the casing, and configured to generate a rotation force; a compression unit installed at the inner space of the casing, and configured to compress a refrigerant by receiving a rotation force of the driving motor; a crank shaft having an oil hole therein, and configured to transmit the rotation force of the driving motor to the compression unit; and an oil feeder installed so as to be communicated with the oil hole of the crank shaft, and configured to pump up the oil of the casing, wherein an oil supply amount is saturated at a rotation speed corresponding to 70~80% of a rotation speed of the driving motor or more than.

Advantageous Effects of Invention

The compressor of the present invention may have the following advantages.

Firstly, an oil supply amount in a low speed driving mode may be increased by controlling a shape of an oil passage and the oil feeder, and an oil supply amount in a constant or high speed driving mode may be restricted by making the oil supply amount to be in a saturated state when the compressor has reached a predetermined speed.

Secondly, the compressor may have an enhanced performance by supplying a sufficient amount of oil to components where sliding occurs not only in a high speed driving mode but also in a low speed driving mode.

BEST MODE FOR CARRYING OUT THE INVENTION

Reference will now be made in detail to the preferred embodiments of the present invention, examples of which are illustrated in the accompanying drawings.

Hereinafter, a compressor according to the present invention will be explained in more detail.

Figure 1:
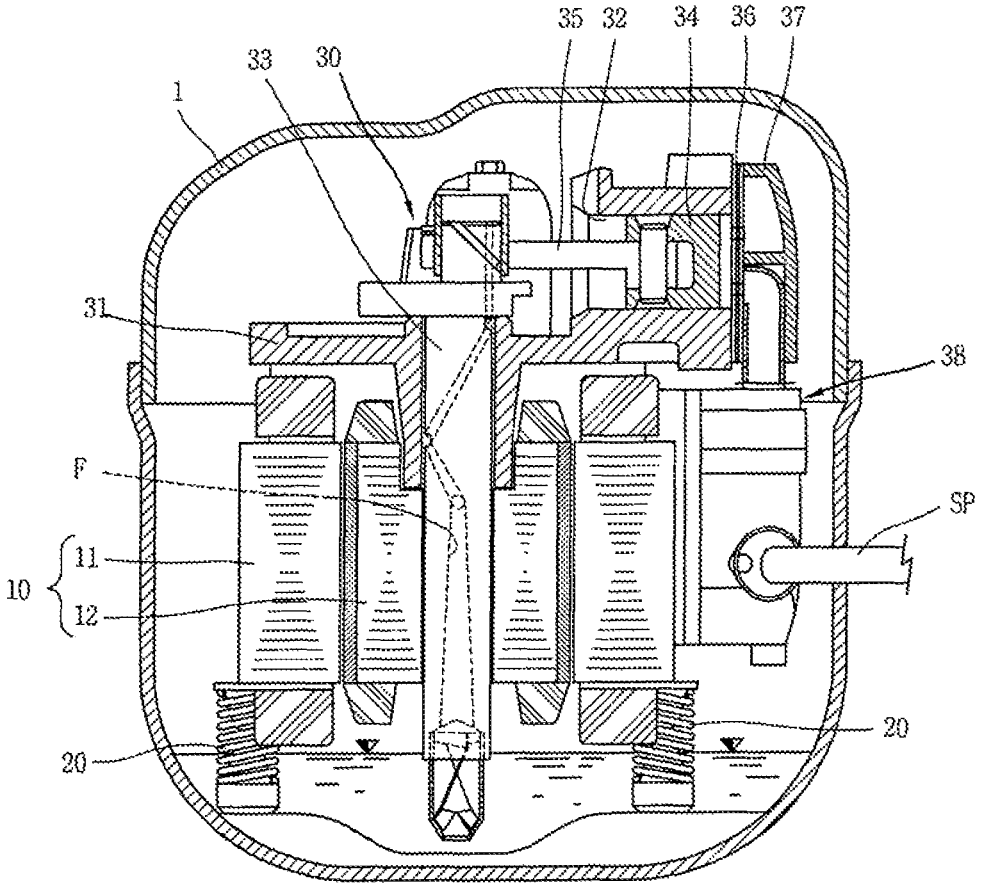
FIG. 1 CONVENTIONAL ART
FIG. 1 is a sectional view of a reciprocating compressor in accordance with the conventional art.
Figure 2:
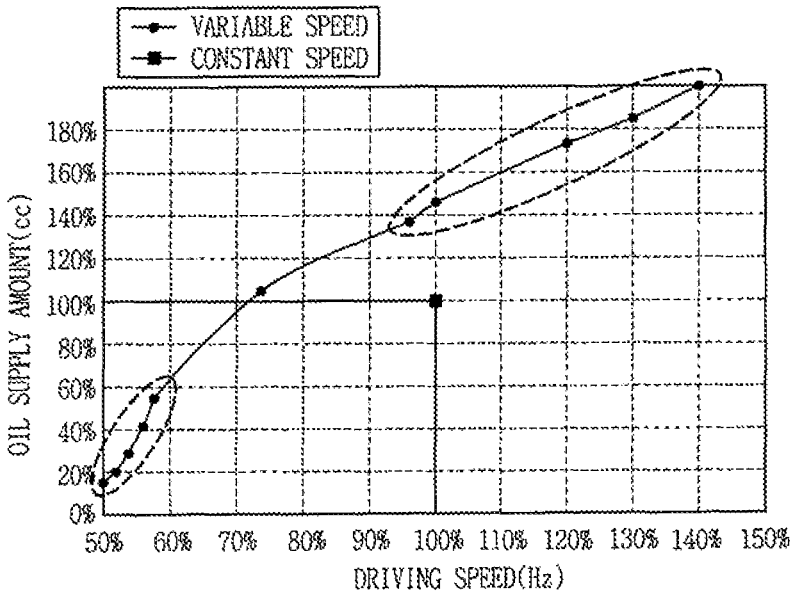
FIG. 2 CONVENTIONAL ART
FIG. 2 is a graph showing a change of an oil supply amount according to a change of a driving speed in the reciprocating compressor of FIG. 1.
Figure 3:
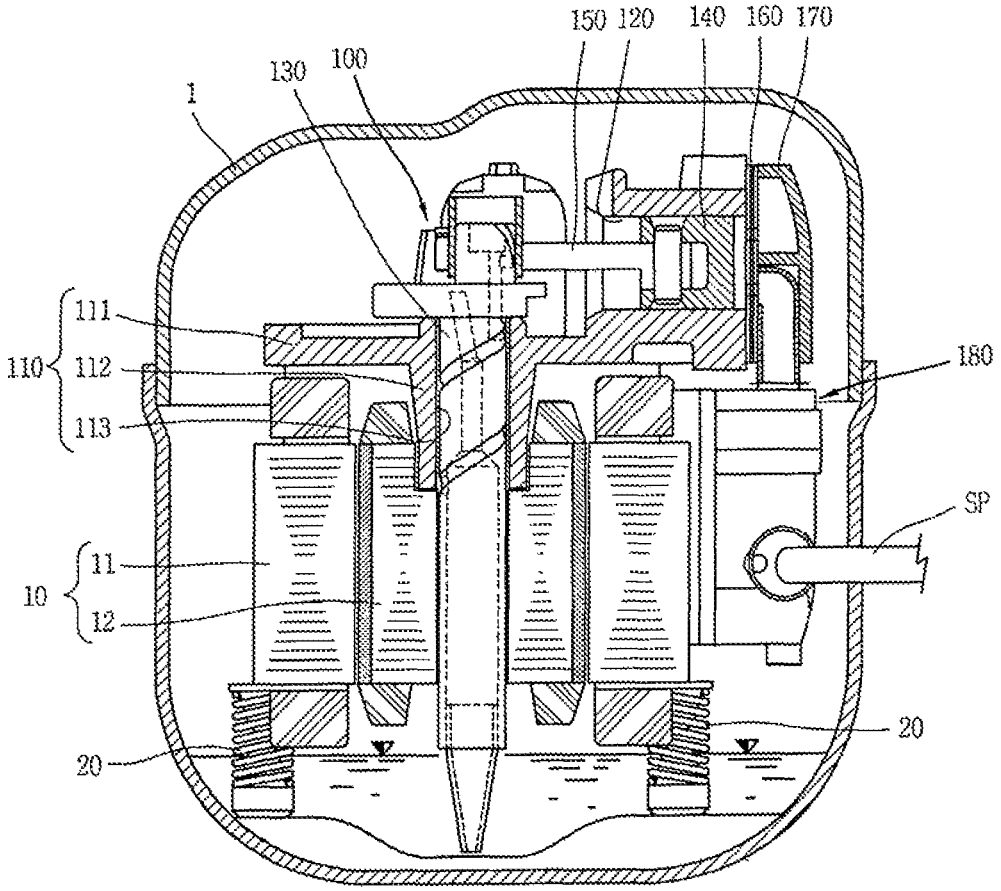
FIG. 3 is a sectional view of a reciprocating compressor according to the present invention.

FIG. 3 is a sectional view of a reciprocating compressor according to the present invention.

As shown, the reciprocating compressor comprises a casing 1 having oil contained at a bottom thereof, a driving motor 10 installed in the casing 1 and configured to generate a driving force, a supporting unit 20 configured to elastically support the driving motor 10, and a compression unit 100 disposed above the driving motor 10.

The compression unit 100 includes a frame 110 disposed above the driving motor 10, a cylinder block 120 integrally provided at the frame 110, a crank shaft 130 penetratingly-inserted into the frame 110 and forcibly-inserted into a rotor 12 of the driving motor 10, a piston 140 inserted into the cylinder block 120, a connecting rod 150 configured to convert a rotary motion of the crank shaft 130 into a linear reciprocation by connecting a cam portion 133 of the crank shaft 130 to the piston 140, a valve assembly 160 coupled to the cylinder block 120, a discharge muffler 170 coupled to the cylinder block 120 so as to encompass the valve assembly 160, and a suction muffler 180 installed at the valve assembly 160 so as to be connected to the valve assembly 160.

The frame 110 includes a body portion 111 having a flat shape in a horizontal direction, a boss portion 112 extendingly-formed at one side of a bottom surface of the body portion 111 in a vertical direction, and a shaft insertion hole 113 penetratingly-formed at the boss portion 112 and configured to insertion-support the crank shaft 130 therein.

Figure 4:
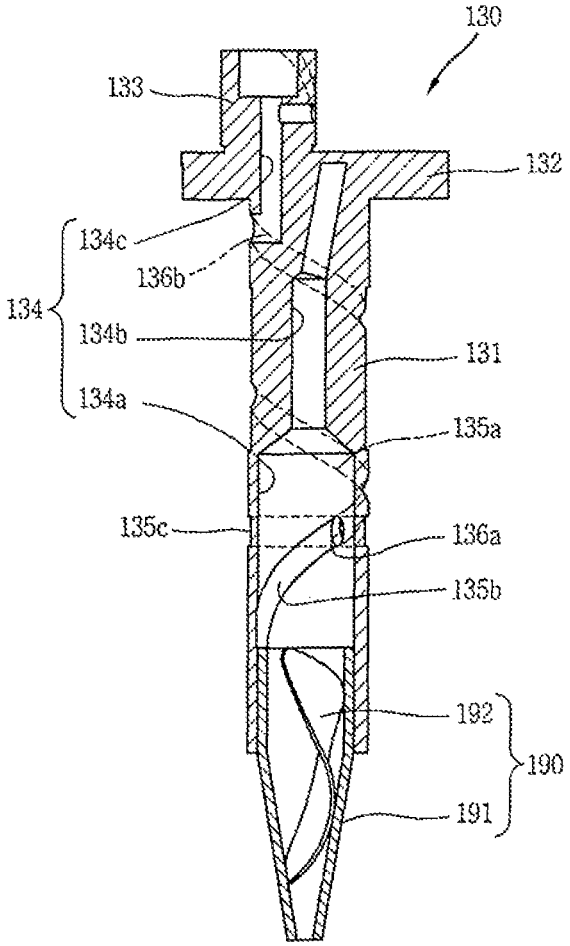
FIG. 4 is a longitudinal sectional view showing an assembled state of an oil feeder to a crank shaft in the reciprocating compressor according to the present invention.

As shown in FIG. 4, the crank shaft 130 includes a shaft portion 131 having a predetermined length and inserted into the shaft insertion hole 113 of the frame 110, a balance weight portion 132 extendingly-formed at the end of the shaft portion 131, a cam portion 133 extendingly-formed at one side of the balance weight portion 132 in a predetermined length so as to be eccentric with the shaft portion 111, and configured to couple the connecting rod 150 thereto, and an oil hole 134 penetrating the crank shaft 130 in an axial direction.

The oil hole 134 of the crank shaft 130 includes a first oil hole **134*a* having a predetermined inner diameter corresponding to a predetermined depth in a length direction from a lower end of the shaft portion 131, a second oil hole 134*b* consecutive with the first oil hole 134*a* and formed to have an inner diameter smaller than that of the first oil hole 134*a*, and a third oil hole 134*c* consecutive with the second oil hole 134*b*, inclined from a center line of the second oil hole 134*b* and penetrating the end of the balance weight portion 132**.

On an outer circumferential surface of the shaft portion 131 of the crank shaft 130, formed is an external groove **135*a* communicated with the oil hole 134. On an inner wall of the first oil hole 134*a* of the shaft portion 131, formed is an internal groove 135*b* communicated with the external groove 135*a*. On an outer circumferential or inner circumferential surface of the shaft portion 131, formed is a connection groove 135*c* formed in a ring shape and configured to connect the external groove 135*a* and the internal groove 135*b* with each other. At the connection groove 135*b*, formed is a first communication hole 136*a* configured to communicate the connection groove 135*b* and the external groove 135*a* with each other. Between the external groove 135*a* and the third oil hole 134*c*, formed is a second communication hole 136*b* configured to communicate the external groove 135*a* and the third oil hole 134*c*** with each other.

The external groove **135*a* is formed on the outer circumferential surface of the shaft portion 131 in a spiral shape, and the external groove 135*a* has a predetermined width and depth. Once the crank shaft 130 has been inserted into the shaft insertion hole 113 of the frame 110, a region of the shaft portion 131 where the external groove 135***a* is positioned is implemented on an inner wall of the shaft insertion hole 113. Accordingly, the shaft portion 131 contacts the inner wall of the shaft insertion hole 113 of the frame 110 thus to be supported thereby.

The internal groove 135*b* is implemented in the form of one or more curved lines. The curved line of the internal groove 135*b* is formed in the same direction as a rotation direction of the crank shaft 130, i.e., in an opposite direction to a winding direction of the external groove. Although not shown, when the internal groove 135*b* is formed in plurality in number, the internal grooves 135*b* may be formed in the same direction. In this case, the internal grooves 135*b* may be formed in different directions.

An oil feeder 190 configured to pump up the oil contained at the bottom of the casing 1 is coupled to a lower end of the shaft portion 131.

The same reference numerals were given to the same components as those of the conventional art.

The operation of the compressor according to the present invention will be explained as follows.

As aforementioned, once the driving motor 10 is operated, a rotation force of the driving motor 10 is transmitted to the crank shaft 130 to rotate the crank shaft 130. Then, a rotation force of the crank shaft 130 is transmitted to the piston 140 via the cam portion 133 and the connecting rod 150. As a result, the piston 140 performs a linear reciprocation at an inner space of the cylinder block 120. Here, the valve assembly 160 is together operated to suck gas to the inner space of the cylinder block 120 through the suction muffler 180. The sucked gas is compressed, and then is discharged to outside of the casing 1 through the discharge muffler 170.

The oil contained at the bottom surface of the casing 1 is pumped up by the oil feeder 190 coupled to a lower end of the crank shaft 130 by rotation of the crank shaft 130. This oil is sucked through the oil hole 134 formed in the crank shaft 130, and then is dispersed out to be supplied to components where sliding occurs.

A part of the oil sucked to the first oil hole 134*a* of the oil hole 134 is sucked through the external groove 134*a*, thereby being supplied to a space between the shaft portion 131 of the crank shaft 130 and the shaft insertion hole 113 of the frame 110. This oil flows through the third oil hole 134*c* to be supplied to a space between the cam portion 133 of the crank shaft 130 and the connecting rod 150. Then, this oil is dispersed to inside of the casing 1. Here, if the internal groove 135*b* is formed at the oil hole 134, a sufficient amount of oil may be smoothly sucked to be transmitted to the external groove 135*a*.

The amount of oil sucked through the crank shaft is related to a driving capacity of the compressor, i.e., a rotation speed of the driving motor.

For instance, when the compressor is operated in a large capacity mode, i.e., when the driving motor 10 rotates with a high speed (more than 60 Hz), the oil feeder 190 generates a large pumping force while rotating with a high speed by the rotation force of the crank shaft 130. The oil feeder 190 pumps up the oil contained at the bottom surface of the casing 1 with a large amount. This oil is sucked through the oil hole 134, the internal groove 135*b* and the external groove 135*a* of the crank shaft 130. Then, this oil is dispersed to inside of the casing 1 to be supplied to components where sliding occurs.

On the other hand, when the compressor is operated in a small capacity mode, i.e., when the driving motor 10 rotates with a low speed (less than 45 Hz), the oil feeder 190 rotates with a low speed due to a small rotation force of the crank shaft 130. This may cause a relatively small pumping force. Accordingly, the oil contained at the bottom surface of the casing 1 is not smoothly sucked along a flow passage of the crank shaft 130. As a result, a sufficient amount oil may not be supplied to components where sliding occurs.

The oil feeder 190 and an oil passage 134 have to be formed so that a larger amount of oil can be pumped up in a condition that the driving motor has the same rotation speed, with considering that the driving motor 10 rotates with a low speed. However, when the oil passage 134 and the oil feeder 190 are designed to be profitable for oil supply, a larger amount of oil than an optimum amount can be supplied in a constant speed driving mode (e.g., 50 Hz or 60 Hz) as well as a high speed driving mode. This may cause the aforementioned problems, e.g., increment of an input of the compressor, increment of a surface temperature, and increment of a suction amount and a discharge amount. Accordingly, it is preferable to design the oil passage 134 and the oil feeder 190 so that an oil pumping amount can be decreased in a constant speed driving mode as well as a high speed driving mode, whereas an oil pumping amount can be increased in a low speed driving mode.

Figure 7:
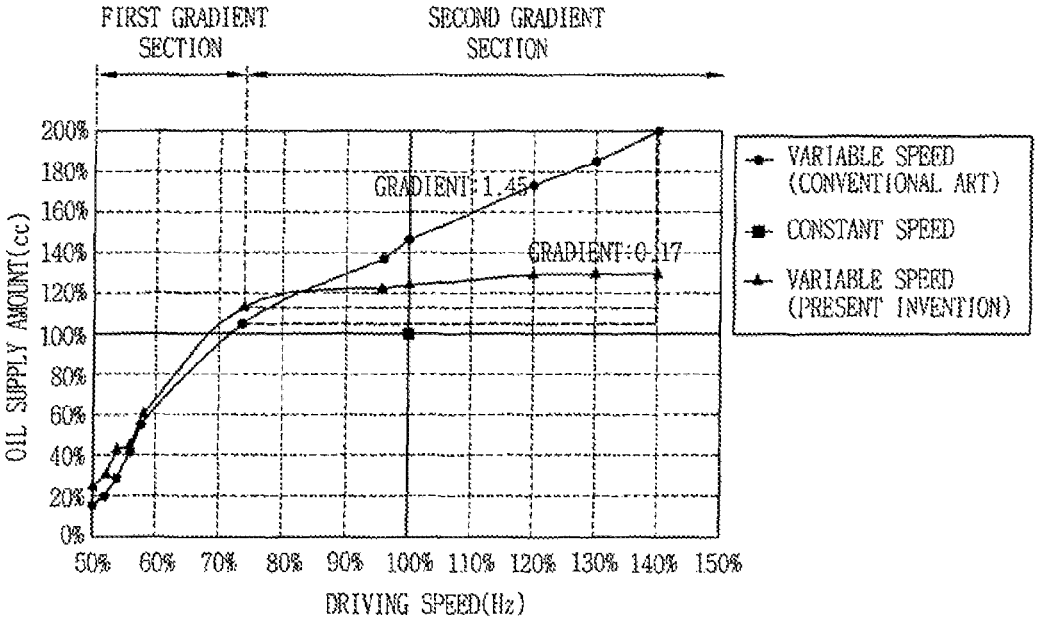
FIG. 7 is a graph comparing a gradient change between an oil supply amount and a driving speed with respect to the external groove and the oil feeder according to the present invention, with that of the conventional art.

For this, the oil passage 134 and the oil feeder 190 have to be designed so that an oil supply amount can be saturated when the driving motor 10 has a predetermined driving speed, e.g., 40 Hz corresponding to about 70% of a rotation speed of a constant speed type driving motor (or constant speed type compressor), or so that a gradient of an oil supply amount with respect to a rotation speed of the driving motor 10 can be less than 1.0 (more preferably less than 0.5). A ratio of an oil supply amount with respect to a rotation speed of the driving motor 10 (hereinafter, will be referred to as a gradient of an oil supply amount) may be defined as an oil supply ratio difference with respect to a rotation speed ratio difference from a point where an oil supply amount is lowered by a degree more than a predetermined level to a maximum rotation speed (e.g., 140% of a constant speed). The oil passage 134 and the oil feeder 190 have to be designed so that the gradient of an oil supply amount with respect to a rotation speed of the driving motor 10 can be less than 1.0 (more preferably less than 0.5). This means that the oil passage 134 and the oil feeder 190 have to be designed so that a second gradient can be smaller than a first gradient as shown in FIG. 7. Here, the first gradient is defined as a gradient of an oil supply amount before a rotation speed of the driving motor 10 reaches a specific speed, and the second gradient is defined as a gradient of an oil supply amount after the rotation speed of the driving motor 10 reaches the specific speed.

Here, the gradient of an oil supply amount may be calculated by dividing an oil supply ratio difference by a rotation speed ratio difference. The rotation speed ratio may be calculated by dividing a rotation speed by a constant speed (50 or 60 Hz). And, the oil supply ratio may be calculated by dividing an oil supply amount according to a rotation speed by an oil supply amount in a constant speed driving mode.

In order for the oil supply amount to be saturated or to have a gradient less than 1.0 (preferably less than 0.5) at a region corresponding to 70% of a rotation speed of the driving motor 10 (constant speed type driving motor) or more than, the number of turns of the external groove 135*a* disposed on the outer circumferential surface of the crank shaft 130 is properly controlled, and the shape of the oil feeder 190 is properly changed.

Figure 5:
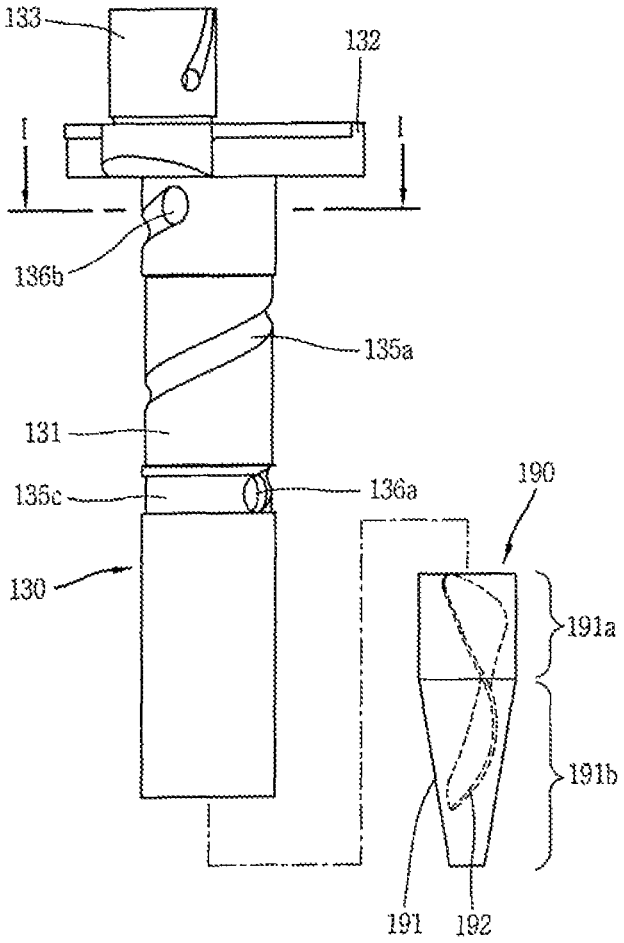
FIG. 5 is a frontal view of the crank shaft and the oil feeder of FIG. 4.
Figure 6:
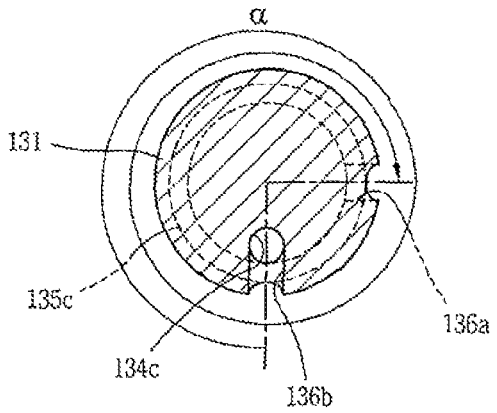
FIG. 6 is a sectional view taken along line I-I in FIG. 5, which is for explaining the number of turns of an external groove.

FIG. 4 is a longitudinal sectional view showing an assembled state of the oil feeder to the crank shaft in the reciprocating compressor according to the present invention, FIG. 5 is a frontal view of the crank shaft and the oil feeder of FIG. 4, and FIG. 6 is a sectional view taken along line I-I in FIG. 5, which is for explaining the number of turns of the external groove.

As shown in FIGS. 4 to 6, the number of turns of the external groove 135*a* is preferably in the range of about 1~2 so that a flow resistance against oil can be generated from the external groove 135*a* when the rotation speed of the driving motor 10 reaches about 40 Hz, i.e, so that a winding angle ($\alpha$) from the first communication hole 136*a* to the second communication hole 136*b* can be about 360~720° When the number of turns of the external groove 135*a*, i.e., the number of turns of the external groove 135*a* from the first communication hole 136*a* to the second communication hole 136*b* is less than 1, a big difference occurs between an oil supply amount in a high speed driving mode and an oil supply amount in a low speed driving mode like in the conventional art. On the other hand, when the number of turns of the external groove 135*a* is more than 1.75, a saturated oil supply amount does not occur if the driving motor rotates with a low speed less than a specific speed. Accordingly, the number of turns of the external groove 135*a* is preferably in the range of 1~1.75.

As shown in FIGS. 4 and 5, the oil feeder 190 includes a guide member 191 fixed to a lower end of the crank shaft 130 and configured to guide flow of oil by being communicated with the oil hole 134, and a pumping member 192 inserted into the guide member 191 and configured to pump up oil.

The guide member 191 consists of a cylindrical portion 191*a* having the same inner diameter and coupled to a lower end of the first oil hole 134*a* of the crank shaft 130, and a conical portion 191*b* integrally extending from a lower end of the cylindrical portion 191*a* and having an inner diameter gradually decreased towards a lower side. Here, the conical portion 191*b* is formed to have a length longer than that of the cylindrical portion 191*a*, so as to smoothly pump up oil.

A depth of the guide member 191 soaked in oil may be in the range of 10~30% of a height of a starting end of the external groove 135*a*, preferably 15~25%. For instance, in an assumption that the compressor is kept at an ordinary temperature, the height of the starting end of the external groove 135*a* is in the range of about 65~68 mm, and the depth of the guide member 191 soaked in oil is in the range of 10~16 mm.

In the reciprocating compressor according to the present invention, an oil supply amount through the oil hole 134 of the crank shaft 130 is increased in a low speed driving mode, but is decreased in a constant speed driving mode as well as a high speed driving mode.

FIG. 7 is a graph comparing a gradient change between an oil supply amount and a driving speed with respect to the external groove and the oil feeder according to the present invention, with that of the conventional art.

As shown, in the conventional art, when the driving motor rotates with a low speed driving mode (about 50% of a constant speed), an oil supply amount is less than 20% of that in a constant speed driving mode. Furthermore in the conventional art, an oil pumping amount is increased to a gradient of about 1.45 as the rotation speed of the driving motor is increased. However, in the reciprocating compressor having the oil passage 134 and the oil feeder 190 of the present invention, an oil supply amount is increased when the rotation speed of the driving motor 10 is low. And, in the present invention, a saturation phenomenon occurs, i.e., an oil supply amount is not significantly increased when the rotation speed of the driving motor 10 is constant or high. That is, in the present invention, an oil supply amount in a low speed driving mode is increased by 20% of an oil supply amount in a constant speed driving mode or more than. On the other hand, an oil supply amount is decreased as a gradient of a motor rotation ratio with respect to an oil supply amount is drastically decreased, from a region of about 35~40 Hz corresponding to 75% of that in a constant speed driving mode.

In the present invention, the shape of the oil passage and the oil feeder are properly controlled, thereby increasing an oil supply amount in a low speed driving mode of the driving motor, but decreasing an oil supply amount in a constant speed driving mode or a high speed driving mode by implementing a saturation state. Under these configurations, the compressor of the present invention may have an enhanced performance by sufficiently supplying oil to components where sliding occurs not only in a low speed driving mode but also in a high speed driving mode.

The compressor of the present invention was applied to a reciprocating compressor. However, the compressor of the present invention may be also applied to a rotation type of motor, and a compressor capable of pumping up oil when the rotation type of motor rotates.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A compressor, comprising:

a casing having oil contained at an inner space thereof;

a drive motor installed at the inner space of the casing, and configured to generate a rotational force;

a compression device installed at the inner space of the casing, and configured to compress a refrigerant by receiving the rotational force of the drive motor;

a crank shaft having an oil hole therein, and configured to transmit the rotational force of the drive motor to the compression device; and an oil feeder installed so as to communicate with the oil hole of the crank shaft, and configured to pump up the oil of the casing, wherein the crank shaft is provided, on an outer circumferential surface thereof, with an external groove formed in a spiral shape so as to communicate with the oil hole, wherein the crank shaft is provided with an internal groove on an inner circumferential surface of the oil hole thereof, and the internal groove is formed to communicate with the external groove, and wherein the internal groove has a winding direction opposite to a winding direction of the external groove.

2. The compressor of claim 1, wherein a number of turns of the external groove is in a range of 1~2.

3. The compressor of claim 2, wherein the number of turns of the external groove is in the range of 1~1.75.

4. The compressor of claim 2, wherein a length from a starting point of the external groove to an end of the oil feeder is longer than a length from the starting point of the external groove to an upper end of the crank shaft.

5. The compressor of claim 1, wherein a ring-shaped groove configured to connect the external groove and the internal groove with each other is formed on an outer circumferential surface of the crank shaft.

6. The compressor of claim 1, wherein the oil feeder comprises:

a guide fixed to the oil hole of the crank shaft, and configured to guide flow of oil; and a pump inserted into the guide member and configured to pump up oil, wherein the guide comprises a first portion having a consistent inner diameter, and a second portion that extends from the first portion and having an inner diameter that gradually decreases.

7. The compressor of claim 6, wherein the second portion of the guide has a length longer than a length of the first portion.

8. The compressor of claim 6, wherein a depth of the guide soaked in oil is in a range of about 15~25% of a height of a starting end of the external groove.

9. A compressor, comprising:

a casing having oil contained at an inner space thereof;

a drive motor installed at the inner space of the casing, and configured to generate a rotational force;

a compression device installed at the inner space of the casing, and configured to compress a refrigerant, by receiving the rotational force of the drive motor;

a crank shaft having an oil hole therein, and configured to transmit the rotational force of the drive motor to the compression device, and an oil feeder installed so as to communicate with the oil hole of the crank shaft, and configured to pump up the oil of the casing, wherein the crank shaft is provided, on an outer circumferential surface thereof, with an external groove formed in a spiral shape so as to communicate with the oil hole, wherein the crank shaft is provided with an internal groove on an inner circumferential surface of the oil hole thereof, and the internal groove is formed to communicate with the external groove, and wherein a ring-shaped groove configured to connect the external groove and the internal groove with each other is formed on the outer circumferential surface of the crank shaft.

10. The compressor of claim 9, wherein a number of turns of the external groove is in a range of 1~2.

11. The compressor of claim 10, wherein the number of turns of the external groove is in the range of 1~1.75.

12. The compressor of claim 10, wherein a length from a starting point of the external groove to an end of the oil feeder is longer than a length from the starting point of the external groove to an upper end of the crank shaft.

13. The compressor of claim 9, wherein the oil feeder comprises:

a guide fixed to the oil hole of the crank shaft, and configured to guide flow of oil; and a pump inserted into the guide and configured to pump up oil, wherein the guide comprises a first portion having a consistent inner diameter in an axial direction, and a second portion that extends from the first portion and having an inner diameter that gradually decreases in an axial direction.

14. The compressor of claim 13, wherein the second portion of the guide has a length longer than a length of the first portion.

15. The compressor of claim 13, wherein a depth of the guide soaked in oil is in a range of about 15~25% of a height of a starting end of the external groove.

* * * * *